United States Patent [19]

Schüler et al.

[11] 3,949,943

[45] Apr. 13, 1976

[54] MILL BOWL LINING CONSTRUCTION

[75] Inventors: Udo Schüler, Stetten, Filder; Herbert Hess, Kornwestheim; Günter Klotz, Marbach, all of Germany

[73] Assignee: EVT Energie-und Verfahrenstechnik GmbH, Stuttgart, Germany

[22] Filed: Nov. 25, 1974

[21] Appl. No.: 526,946

[30] Foreign Application Priority Data

Nov. 2, 1973 Germany ..... 2354844

[52] U.S. Cl. ..... 241/183; 241/299

[51] Int. Cl.[2] ..... B02C 17/22

[58] Field of Search ..... 241/179, 181–183, 241/284, 299

[56] References Cited

UNITED STATES PATENTS

| | | | |
|---|---|---|---|
| 1,534,000 | 4/1925 | Baker | 241/183 |
| 2,611,546 | 9/1952 | Posselt | 241/183 |
| 3,107,867 | 10/1963 | Svensson et al. | 241/183 X |
| 3,318,537 | 5/1967 | Wallin et al. | 241/183 |
| 3,378,209 | 4/1968 | Crocheron | 241/182 X |
| 3,580,520 | 5/1971 | Myers | 241/183 X |
| 3,820,727 | 6/1974 | Russell | 241/299 X |

*Primary Examiner*—Granville Y. Custer, Jr.
*Assistant Examiner*—Howard N. Goldberg
*Attorney, Agent, or Firm*—Kenyon & Kenyon Reilly Carr & Chapin

[57] ABSTRACT

A roller mill-bowl lining comprising a plurality of individual segments disposed adjacent to each other in an annular ring-like arrangement. The segments of the ring have the adjacent end portions thereof configured in an angular, interlocking shape so that upon the breakage of one of the segments the lining will not lift away from the mill bowl.

4 Claims, 5 Drawing Figures

MILL BOWL LINING CONSTRUCTION

BACKGROUND OF THE INVENTION

1. Field of the Invention

This invention relates generally to roller mills, and in particular to an improved mill bowl lining construction for such mills.

2. Description of the Prior Art

Linings for the mill bowls of roller mills comprising a plurality of individual segments disposed in an annular, ring like arrangement are generally known in the art. See, for example, German patent No. 1,044,568. Generally speaking, the lining rotates with the mill bowl, and the mill rollers are pressed in a direction towards the mill bowl lining from the inside of the mill bowl. It often happens during the operation of such mills that individual segments of the mill bowl lining subject to unfavorable loading conditions are broken by the pressure exerted by the mill rollers on the material being milled. As a result of mill bowl vibration which occurs during milling, these broken segments become detached from the mill bowl lining and drop into the inside of the mill bowl. The protection provided by these segments to the mill bowl against wear is thus lost, and the entire lining becomes displaced within the mill bowl. A long shutdown of the mill, and expensive repairs are then required.

SUMMARY OF THE INVENTION

It is therefore an object of the invention to overcome the aforementioned disadvantages of heretofore known mill bowl linings, and to provide an improved lining construction which permits operation of the roller mill to be carried out without damage to the mill bowl upon the breakage of one or more of the mill bowl lining segments.

This and other objects are achieved by the invention in a roller mill of the type including a mill bowl, and a lining disposed in the mill bowl comprising a plurality of individual segments disposed adjacent each other in an annular ring-like arrangement. The improvement of the invention comprises the fabrication of the lining segments so that the adjacent end portions thereof are configured in an angular, interlocking shape. By so configuring the abutting surfaces of the segments, movement of an individual segment after the breakage thereof is prevented, and such breakage thus cannot loosen the entire mill bowl lining.

These and other features of the invention will be described in further detail in the following detailed description.

DETAILED DESCRIPTION

Figure 1:
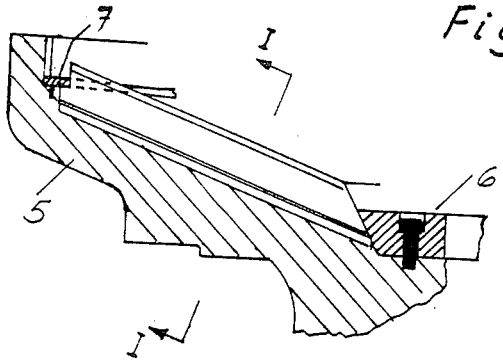
FIG. 1 is a partial, cross-sectional view of a mill bowl including the improved mill bowl lining of the invention.
Figure 2:
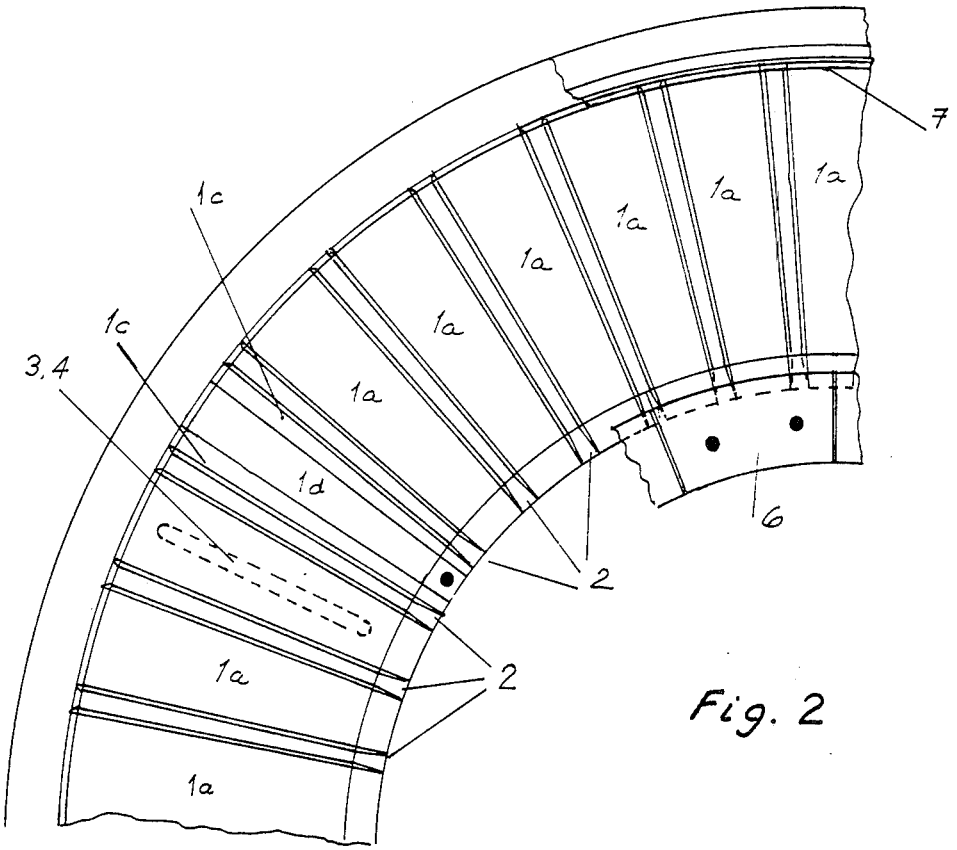
FIG. 2 is a partial plan view of the improved mill bowl lining constructed according to the invention.
Figure 5:
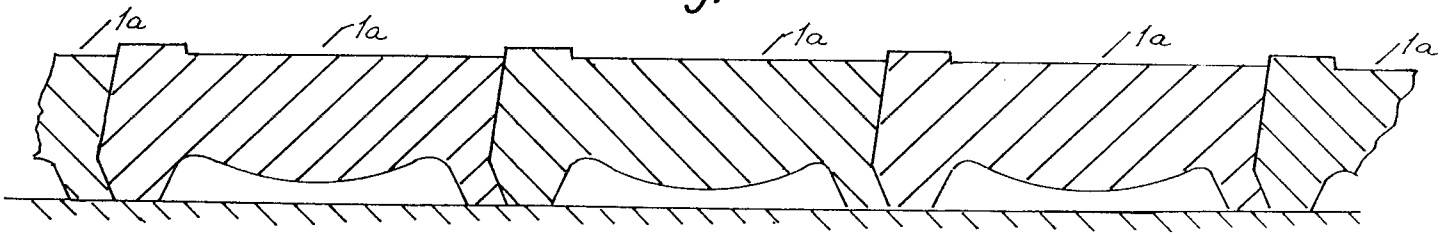
FIG. 5 is a partial cross-sectional view of the mill bowl lining illustrated in FIGS. 1 and 2, taken along section I—I of FIG. 1.

Referring now to the drawings, in particular to FIGS. 1, 2 and 5, there is shown the mill bowl 5 of a roller mill which is rotatable about a fixed shaft (not shown). A mill bowl lining is disposed in bowl 5 and comprises a plurality of individual segments 1a disposed in an annular, ring-like arrangement. The rollers of the mill (also not shown) engage the lining segments from the inside of the mill bowl. As is shown in FIG. 5, the segments 1a have the adjacent end portions thereof configured in an angular, interlocking shape. With such a lining design, breakage of the segments, which may be caused by loading forces exerted in a direction transverse to the longitudinal direction of the segments, does not result in lifting away of the broken segments and loosening of the entire mill bowl lining.

Figure 3:
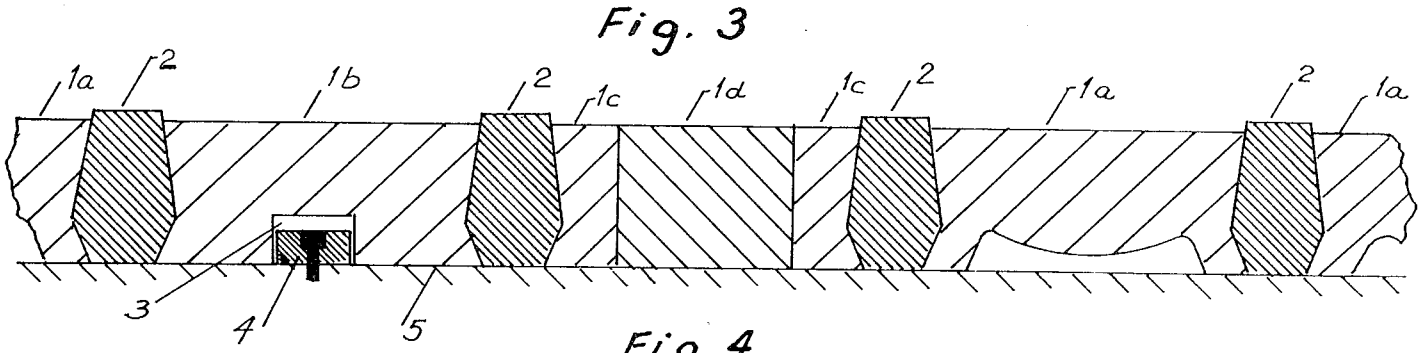
FIG. 3 is a partial cross-sectional view of another embodiment of a mill bowl lining constructed according to the invention.
Figure 4:
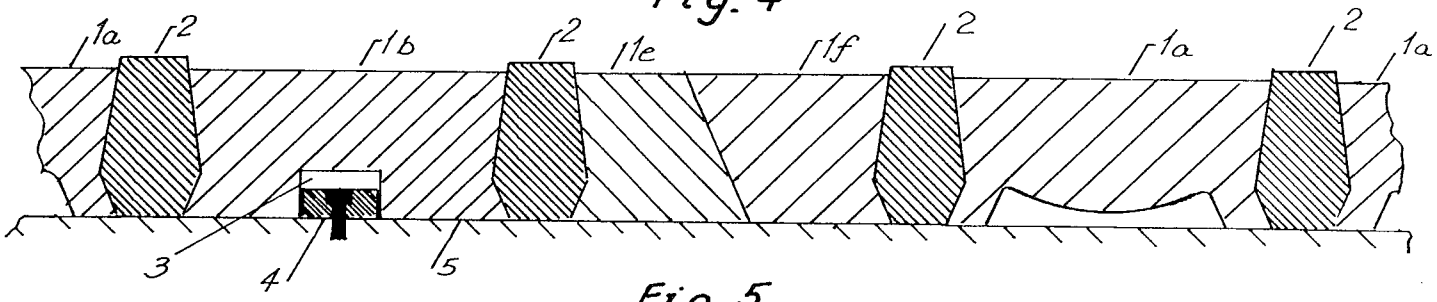
FIG. 4 is a partial cross-sectional view of a further embodiment of the mill bowl lining.

As illustrated in FIGS. 3 and 4, a plurality of interlay members 2 may be interposed between segments 1*a*. These members have a thickness which is greater than that of the segments 1*a* and thus extend radially beyond the lining surface into the inside of the mill bowl. Members 2 also are preferably fabricated of material which has a greater wear resistance than that of which the segments are fabricated, and have a cross-sectional shape which is symmetrical. By utilizing this type of mill bowl lining arrangement, even upon the breakage of intermediate segment layers, which bear the main loading forces during milling, approximately parallel to the mill ring surface, it is almost impossible for detachment of the mill bowl lining to occur.

The lining may also further comprise at least one radially extending tongue member 4 which is disposed on the surface of the mill bowl, and at least one longitudinal groove 3 disposed in the surface of at least one of the segments 1*b* for receiving the tongue member. Groove 3 and member 4 form a tongue and groove type coupling between mill bowl 5 and the mill bowl lining for preventing tangential displacement of the lining with respect to the bowl. Additional end-piece segments may also be disposed between adjacent ones of individual segments 1*a* and are longitudinally divided into a plurality of longitudinal segments at least one of which is detachably coupled to mill bowl 5. In FIG. 3, the end-piece segment is divided twice into segments 1*c* and 1*d*, the latter of which is coupled by any suitable means to the mill bowl. In FIG. 4, the end-piece segment is divided once into two longitudinal segments 1*e* and 1*f*, the latter of which is also coupled to mill bowl 5. Such a lining construction permits greater dimensional tolerances in fabricating the lining from the segments, and even with respect to the dimensions of the intermediate layers. Any deviation from required segment dimensions can be compensated for simply by machining the end-piece segments of the lining. This is very significant cost-wise, since because the lining segments are fabricated of hard castings, machining thereof is expensive. As shown in FIG. 1, suitable fastening means, such as holders 6 and 7, disposed in engagement with the radially inner and outer edges of the mill bowl lining and coupled to the mill bowl, secure the lining segments to the mill bowl and prevent movement of the segments away from the latter.

In the foregoing specification, the invention has been described with reference to specific exemplary embodiments thereof. It will, however, be evident, that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a roller mill of the type including a mill bowl, and a lining disposed in the mill bowl comprising a plurality of individual segments disposed adjacent each other in an annular, ring-like arrangement and fastened to said mill bowl at the radially inner and outer edges thereof, the improvement comprising said segments having the adjacent engaging sides thereof configured in an angular, interlocking shape and being interlocked with one another, and said mill bowl lining including a plurality of interlay members interposed between said segments having the sides thereof engaging said segments configured in an angular interlocking shape and being interlocked with said segments and having a thickness which is greater than that of said segments so as to extend beyond the lining formed by said segments into said mill bowl.

2. In the roller mill recited in claim 1, said interlay members being fabricated of material having a greater wear resistance than that of said segments and having a symmetrical cross-sectional shape and a width which is greater between the upper and lower surfaces of said lining than at said upper and lower surfaces of said lining.

3. In the roller mill recited in claim 2, said mill bowl lining further comprising at least one radially extending tongue member disposed on the surface of said mill bowl, and at least one longitudinal groove disposed in the surface of at least one of said segments for receiving said tongue member, said member and said groove forming a tongue and groove type coupling between said mill bowl and said mill bowl lining for preventing tangential displacement thereof.

4. In the roller mill recited in claim 3, said mill bowl lining further comprising at least one additional end-piece segment disposed between adjacent individual segments, said end piece segment being longitudinally divided into a plurality of longitudinal segments at least one of which is detachably coupled to said mill bowl.

* * * * *